US009506179B2

(12) United States Patent
Geyer et al.

(10) Patent No.: US 9,506,179 B2
(45) Date of Patent: Nov. 29, 2016

(54) MODULAR SYSTEM FOR DRUMS OF LAUNDRY CARE DEVICES

(75) Inventors: Johannes Geyer, Haar (DE); Uwe Ratfisch, Berlin (DE); Wilfried Wildung, Berlin (DE)

(73) Assignee: BSH Hausgeräte GmbH, München (DE)

( * ) Notice: Subject to any disclaimer, the term of this patent is extended or adjusted under 35 U.S.C. 154(b) by 1448 days.

(21) Appl. No.: 12/308,845

(22) PCT Filed: Jun. 6, 2007

(86) PCT No.: PCT/EP2007/055547

§ 371 (c)(1),
(2), (4) Date: Dec. 22, 2008

(87) PCT Pub. No.: WO2008/000593

PCT Pub. Date: Jan. 3, 2008

(65) Prior Publication Data

US 2009/0308109 A1 Dec. 17, 2009

(30) Foreign Application Priority Data

Jun. 27, 2006 (DE) ..... 10 2006 029 481

(51) Int. Cl.

| | |
|---|---|
| ***D06F 37/06*** | (2006.01) |
| *D06F 25/00* | (2006.01) |
| *D06F 58/04* | (2006.01) |
| *D06F 37/04* | (2006.01) |

(52) U.S. Cl.

CPC ..... *D06F 37/06* (2013.01); *D06F 25/00* (2013.01); *D06F 37/04* (2013.01); *D06F 58/04* (2013.01)

(58) Field of Classification Search

CPC ..... D06F 37/06

See application file for complete search history.

(56) References Cited

U.S. PATENT DOCUMENTS

| | | | | |
|---|---|---|---|---|
| 1,389,182 | A * | 8/1921 | Binder | 68/142 |
| 3,938,260 | A | 2/1976 | Brenner et al. | |
| 2002/0083743 | A1 | 7/2002 | Uszkureit et al. | |
| 2004/0129036 | A1* | 7/2004 | Ratfisch | 68/142 |
| 2006/0162395 | A1* | 7/2006 | La Belle et al. | 68/133 |

FOREIGN PATENT DOCUMENTS

| | | |
|---|---|---|
| DE | 88 04 246 U1 | 6/1989 |
| DE | 38 43 705 C2 | 2/1996 |
| DE | 297 17 594 U1 | 1/1998 |

(Continued)

OTHER PUBLICATIONS

International Search Report PCT/EP2007/055547.

(Continued)

*Primary Examiner* — Michael Barr
*Assistant Examiner* — Jason Riggleman
(74) *Attorney, Agent, or Firm* — Nixon & Vanderhye P.C.

(57) ABSTRACT

A modular system for drums of laundry care devices including at least one of washing machines and driers, the modular system including at least two similarly configured base bodies for securing to a respective drum, wherein the at least two similarly configured base bodies are configured for mounted receipt of at least two different functional parts, with the at least two different functional parts being interchangeable on a respective one of the at least two different base bodies.

22 Claims, 5 Drawing Sheets

(56) References Cited

FOREIGN PATENT DOCUMENTS

| | | | | |
|---|---|---|---|---|
| DE | 199 25 917 A1 | | 12/2000 | |
| EP | 0 351 671 | | 1/1990 | |
| EP | 1 306 479 | | 5/2003 | |
| EP | 1306479 A2 | * | 5/2003 | ..... D06F 37/06 |
| GB | 2 226 391 | | 6/1990 | |
| WO | WO90/00641 | * | 1/1990 | ..... D06F 39/02 |
| WO | WO 2007/000647 | | 1/2007 | |

OTHER PUBLICATIONS

Office Action issued Dec. 9, 2015, in a corresponding German Application No. 07 729 922.0-1710 (27 pages).

* cited by examiner

Fig. 8
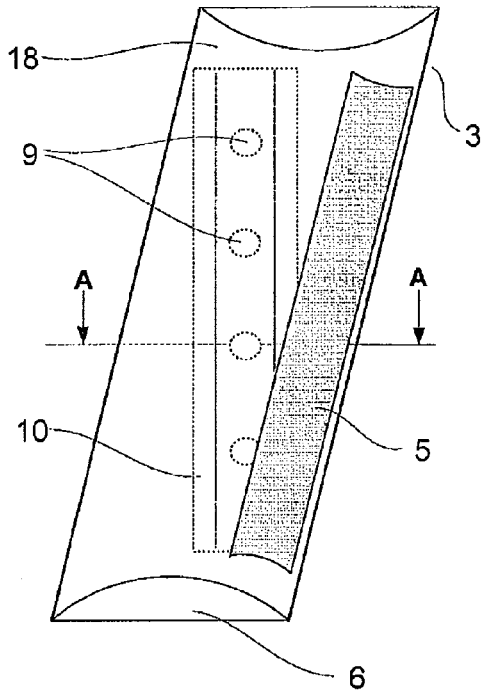
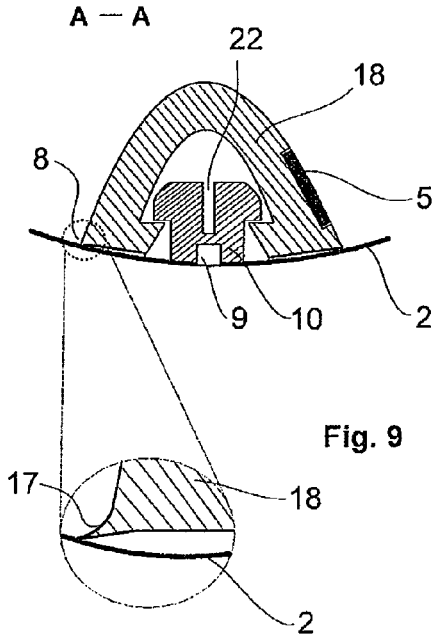
Fig. 9
Fig. 10
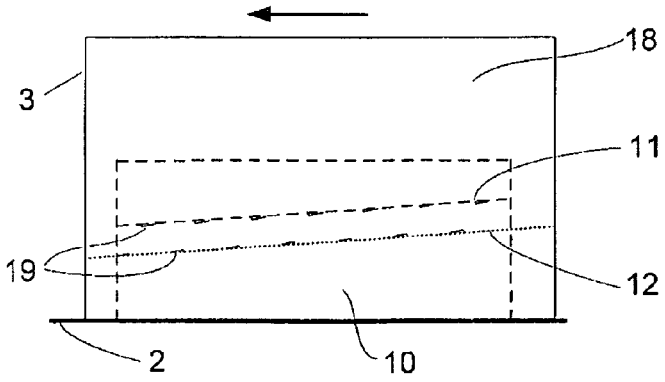

MODULAR SYSTEM FOR DRUMS OF LAUNDRY CARE DEVICES

BACKGROUND OF THE INVENTION

The invention relates to a modular system for drums for laundry care devices such as washing machines or driers. Drums serving to accommodate the laundry have the basic form of a hollow cylinder with a loading opening for loading and unloading the drum in the outer surface or in the front base plate.

Drums of this type have additional functional parts that are firmly attached to the drum or are formed therein. In conjunction with the drum or with other assemblies connected to the drum, the functional parts serve to intensify the washing or drying process, for example, as a component of the liquid flow system, the washing agent and additive dosing or the air inflow or outflow system.

Drums often have, as functional parts, a plurality of symmetrically arranged agitators which are attached to the inner wall of the drum casing or are formed into the drum casing. Agitators are used, in particular, to intensify the washing or drying process in that, on rotation of the drum, the laundry is lifted to a higher level, from which it then falls again. Agitators belonging to the prior art have a form which is similar in cross-section to symmetrical or asymmetrical triangles. The agitators used as single parts are usually made from plastics. Their attachment to the inner wall of the drum casing must be sufficiently secure, particularly in the case of washing machines, due to the not insignificant mechanical loads arising during operation. At the contact surfaces between the agitators and the drum casing, there must be no gaps into which laundry could penetrate and thereby become damaged.

In order to carry out particular washing functions, for example, to achieve a special scooping behavior with the aid of the agitators and to allow the scooped washing water to fall equally distributed or to impart a favored direction to the laundry as the drum rotates, several specially formed agitators which deviate from the usual orientation parallel to the axis and from the even triangular profile have been developed. DE 88 04 246 U1 discloses a screw-shaped curved agitator, by means of which the laundry is transported in the direction of the loading opening. This is intended to facilitate emptying of the laundry drum by the customer.

DE 199 25 917 A1 proposes, for a washing machine with a drum rotation axis which is inclined rising slightly toward the loading opening, an agitator which is arranged not parallel to the axis, but inclined to the direction of rotation. The aim is to impart to the laundry an additional movement component and to transport it forward to the loading opening. With this form of agitator and a matching arrangement of the scooping openings and of the washing water outlet openings, it is also achieved that the scooped washing water is lifted to a higher level and can fall evenly distributed over the laundry. This accelerates wetting of the laundry with washing water.

A three-part agitator especially configured for driers is disclosed in DE 38 43 705 C2. This known agitator comprises two similar carrier parts which, interlocked with one another, carry a measuring electrode which serves to detect the moisture content in the laundry. On assembly of the agitator, the measuring electrode, which consists of a bent sheet metal part is inserted into one of the carrier parts and then the other carrier part, is locked together with the first carrier part. The complete agitator is then screwed to the drum.

The agitators described have the disadvantage in common that the attachment thereof is no longer accessible after installation in the drum. From the standpoint of the production technology, this means, in disadvantageous manner, that the agitators must always be joined to the drum during preassembly. Therefore, if special agitators are to be used, a specially produced drum is always necessary. This has the consequence that for every alteration of the form or dimensions of the agitators, a correspondingly large number of different drums must be completely assembled and kept available for the final assembly.

For manufacturers with a wide assortment of models, this involves a substantially greater effort in production and particularly in storage, which makes the production of such devices not insignificantly more expensive. In the interests of more economical production, there is therefore a tendency among many manufacturers towards standardization, and this means that, for different device types, agitators with a uniform and neutral design, and therefore always the same effect in terms of washing technology, are used.

A similar principle applies to other functional parts attached to or molded into the drum.

BRIEF SUMMARY OF THE INVENTION

It is an object of the invention to provide a solution for the problem as described, by means of which the drums can be equipped with a larger variety of functional parts without considerably limiting flexibility in production and increasing warehousing expenses. It is a further object of the invention to be able to respond in production quickly and without difficulty to short-term market-related requirements. Realization of the invention and of the advantages associated therewith should be achievable with little effort.

According to the invention, this object is achieved by the features set out in the exemplary embodiments described herein. Advantageous embodiments of the invention are disclosed herein, the features of which can be applied individually or in any combination or together.

According to the present invention, similarly configured drum bodies can be equipped with at least one set of differently designed functional parts. The functional parts can be, for example, agitators, damping bodies, measuring sensors, or components of the fluid system, of the washing agent and additive dosing system or of the treatment air system. The differently designed functional parts are designed as installation parts or a functional part base body is provided which is complemented with at least one set of differently configured installation parts and is thereby modified.

By this means, a particularly advantageous modular system is produced for drums of laundry treatment machines, which are differentiated by type into washing machines, driers and washer-driers, wherein the drums thereof comprise functional parts such as laundry agitators or the like and wherein, for different models of laundry treatment machines of one type, drums are provided which are identical in the region for connecting to functional parts, wherein at least two sets of functional parts are associated with the drums, said functional parts all being identical to one another in the connecting region and interchangeable with one another.

For the purpose of rationalized production, it is essential that the receptacles for the installation parts and the fastening elements are designed so that the installation part can be installed into the ready assembled laundry care device, in particular via the interior of the drum.

The dimensioning and form of the base body and the receptacle provided therein for the installation part or the receptacle provided in the drum body are designed identically for a series of special instances of use. Technologically, therefore, the drum body or the drum body together with the base body is a standard part for differently designed functional parts. In one embodiment of the invention, the installation parts are produced as individual parts with formed-on fastening means.

The characteristic design of a functional part results from the installation part configured according to the invention. The different design can result from the geometrical form, the visual styling and the configuration of the scooping and/or outlet openings by mean of which, for example, the scooping performance is varied depending on the direction of rotation or the distribution of washing water falling from above onto the laundry can be influenced. By using different forms, materials and colors for the installation part and/or by the application of signs, functional parts for different specific laundry functions can be realized and/or different visual impacts on customers produced, for many different device models from one manufacturer—always with the same drum body or base body, but with different installation parts—without any great effort.

An installation part according to the invention can be used, in particular, as a characterizing style element, for example, for a brand, a model series or a special function of the device. The signs included in or placed on the installation part and having, for example, an advertising function, are very clearly perceived by customers, due to their spatial separation and different emphasis, as having a different content from other signs, particularly from the signs and symbols with a functional purpose on the control panel. Using the functional parts in this form as a characterizing detail for a device model or a function that is to be highlighted has the advantage that other regions of the device, such as the control panel, are not overloaded with additional signs.

Agitators, in particular, are suitable as advertising and/or information carriers, since when loading and emptying the drum, the operating person directs their gaze primarily towards the drum interior and their attention is automatically drawn to the agitators and, in particular, to their flattened end face. Therefore, in one embodiment of the invention, the end face of the agitator facing towards the loading opening has a receptacle for an installation part which is preferably provided with device-specific or function-specific signs.

It is essential for a rationally designed production process that the completion of the functional part base body with the installation part as carrier of the characterizing features for differentiating the different device models can be carried out at an arbitrary point in the assembly line. This means, in particular, that ready assembled devices can be retrofitted with a special installation part.

The effort involved in converting to different installation parts which modify the functional part is not substantial. The drum, which represents a large part of the production effort in washing machine production no longer has to be completely assembled with the functional parts typical of the device during preassembly and kept ready for final assembly in a correspondingly wide variety, as before the use of the invention. A substantial rationalizing effect can be achieved thereby. The use of functional parts designed according to the invention opens up possibilities in production to be able to respond rapidly, based on marketing initiatives, to visual effects or other requirements that are adapted to the market. Adaptation to changing trends of fashion or technology during the production cycle can also be implemented without difficulty.

The invention can be realized with a low additional cost. The production of the installation part is uncomplicated and storage is not expensive, due to their small size. The receptacles for the installation parts can be produced during the molding process for the respective drum part or during the production of the functional part base body by corresponding design of the tools or moulds without any additional production step. The installation part is preferably a separate plastics part with fastening means formed into or onto it. The connection of the base body and the installation part is accomplished by form-fit, gluing or welding or a combination of these connecting techniques. Assembly can be carried out by hand without any special effort. Special tools or additional fastening means are not required.

In one embodiment of the invention, the functional part is constructed from a plurality of parts, comprising a base body, one molded body or a set of differently designed molded bodies and at least one insertion part or a set of differently designed insertion parts which can be placed in or on the molded body. In this preferred variant, the base body has the function of a standardized, that is identical for differently designed molded bodies, fastening part. The molded body essentially determines the specific form of the functional part and the insertion part is designed as a style element characterizing the laundry care device. In addition, the insertion part can be designed as a complementing molded part.

The receptacle for the molded body in the base body and the receptacles for the insertion parts in the molded body, as well as the associated fastening means are dimensioned and molded identically for a plurality of differently designed molded bodies and/or insertion parts.

In such a variant of the functional part, only the base body is to be connected to the drum or formed into the drum casing during pre-assembly. The molded body and the insertion part can also be added into the washing machine or drier at any point in the assembly line, possibly also separately from one another. A substantial rationalizing effect can be achieved thereby and additional free space is achieved in the production planning and design.

BRIEF DESCRIPTION OF THE DRAWINGS

The invention will now be described in greater detail making reference to several exemplary embodiments. Without restricting its applicability to other functional parts, by way of example, only agitators will be described. The agitators described as examples are a subset of the possible combinations that can be produced with the means according to the invention. The examples given represent a special embodiment belonging to a set of differently designed installation parts which can be inserted into the respective receptacle. In the drawings:

FIG. 8 shows an agitator with a molded body and an insertion part in a plan view and in a sectional view, FIG. 9 shows a detail view of the contact region of the agitator, FIG. 10 shows an agitator with a molded body and an insertion part in a longitudinal sectional view.

DETAILED DESCRIPTION OF THE PRESENT INVENTION

Figure 1:
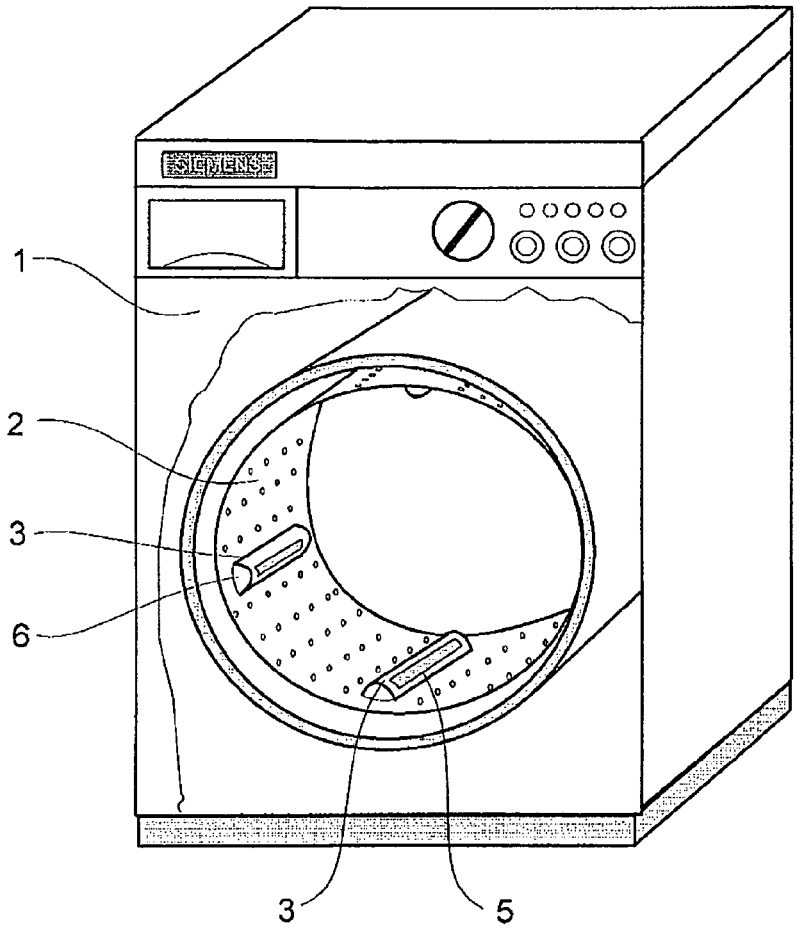
FIG. 1 shows a front perspective view of a washing machine.

The drum 2 of the washing machine 1 shown in FIG. 1, said drum being rotatable about a horizontal axis, comprises agitators 3 arranged with rotational symmetry on the inside of said drum. The agitators 3 are individual parts with an approximately triangular cross-section and are made from plastics. The agitators 3 are fastened on the inside of the drum casing 2 by means of screws which pass through the drum casing 2 from outside.

Figure 3:
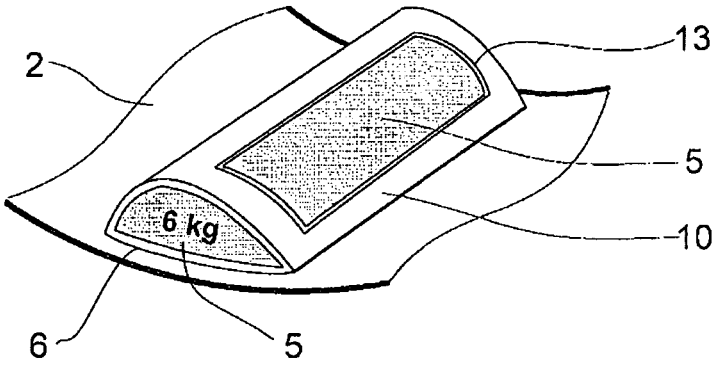
FIG. 3 shows an agitator with an insertion part in a perspective view.
Figure 4:
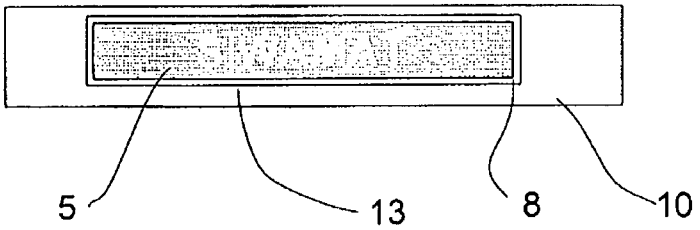
FIG. 4 shows an agitator with an insertion part in a side view, first example.
Figure 5:
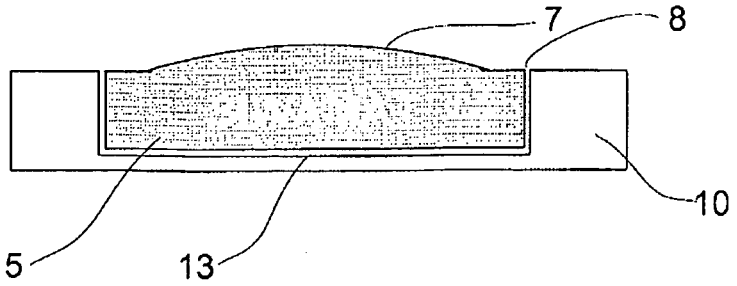
FIG. 5 shows an agitator with an insertion part in a side view, second example.
Figure 6:
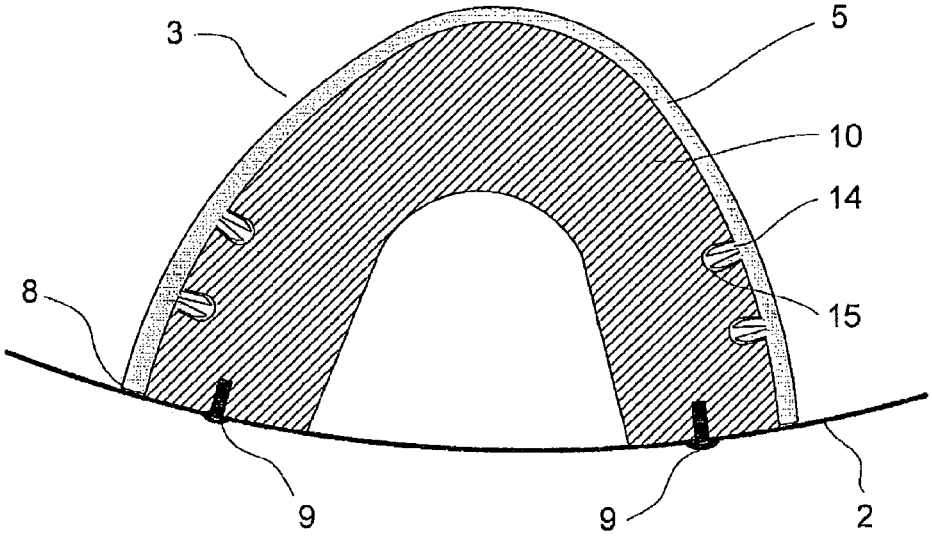
FIG. 6 shows an agitator with an insertion part and a screwed-on base body in a sectional view.

Inserted into each agitator 3 is an insertion part 5 made from plastics. The insertion part 5 fits into the agitator 3 flush with the surface thereof and the base body 10 (FIG. 3) of the agitator 3 has a receptacle 13 which corresponds in its size and shape to the insertion part 5 (FIGS. 3 to 5). The insertion part 5 is held by means of a locking connection in the base body 10 in a manner which is secure in operation over the long term. The locking takes place against the material elastic pretension of the locking rivets 14 (FIG. 6).

The receptacle 13 in the base body 10 has just enough play (FIGS. 4 and 5) so as to facilitate mounting of the insertion part 5, but without any danger of trapping any laundry items. The edges of the receptacle 13 and the edges 8 of the insertion part 5 are rounded in order to prevent the laundry becoming damaged by friction on the edges. Placement of the insertion part 5 is carried out in such a manner that the mould separation burr is covered and thus cannot come into contact with the laundry.

Figure 2:
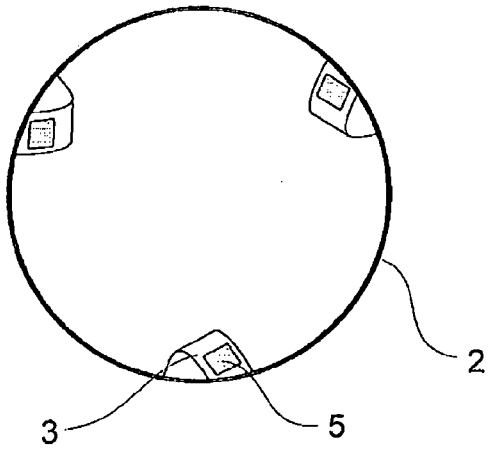
FIG. 2 shows a washing drum in plan view perpendicular to the rotation axis.

The special form of the agitators 3 in the drum 2 and their number, as well as their arrangement, has no limiting effect on the application of the invention. It is useful for the function of the insertion part 5 as a characterizing style element of the washing machine 1 to arrange the insertion part 5 for its optimum perception. The drum 2 shown in FIG. 2 has three asymmetric agitators 3 offset by 120° which are arranged at an acute angle to the axis direction and have an enlarged cross-section toward their rear. The insertion part 5 is readily visible in the example, arranged on the flat flank of the agitator 3 facing toward the observer.

The insertion parts 5 are individually produced parts which are able to stand out clearly from the base body 10 with regard to their color design (FIGS. 1 to 5). In the exemplary embodiments in FIGS. 4 and 5, characters are also introduced into the insertion parts 5 to identify a particular device model. In place of the characters, signs or symbols can be introduced into the insertion part 5, serving as an identifier of the particular device model or as an indication of a particular function. In the exemplary embodiment in FIG. 3, an indication of the load capacity of the drum is applied to the end face 6 of the agitator 3 by means of a second insertion part 5. The end face 6 is readily visible in the flattened form and is therefore particularly suitable for accommodating insertion parts 5 with model-specific or function-specific symbols.

FIG. 5 shows an exemplary embodiment wherein the insertion part 5 almost completely surrounds the base body 10. The insertion part 5 has a convexity 7 by means of which the agitator 3 is given a special form and function. Other agitator forms can readily be realized through suitably differently designed insertion parts 5.

FIG. 6 shows an agitator 3 wherein the insertion part 5 lies flat against the base body 10 and completely surrounds it. In this example, the insertion part 5 serves purely as a visual styling means. At any desired site, characters and/or marks can be introduced into the insertion part 5. The two flanks of the agitator 3 can have different signs.

FIGS. 7, 8 and 10 to 12 show agitators 3 with a three-part embodiment. The agitators 3 are constructed from a base body 10 as the fastening part, a molded body 18 which essentially determines the functional design and an insertion part 5 which is configured as a characterizing style element.

Figure 7:
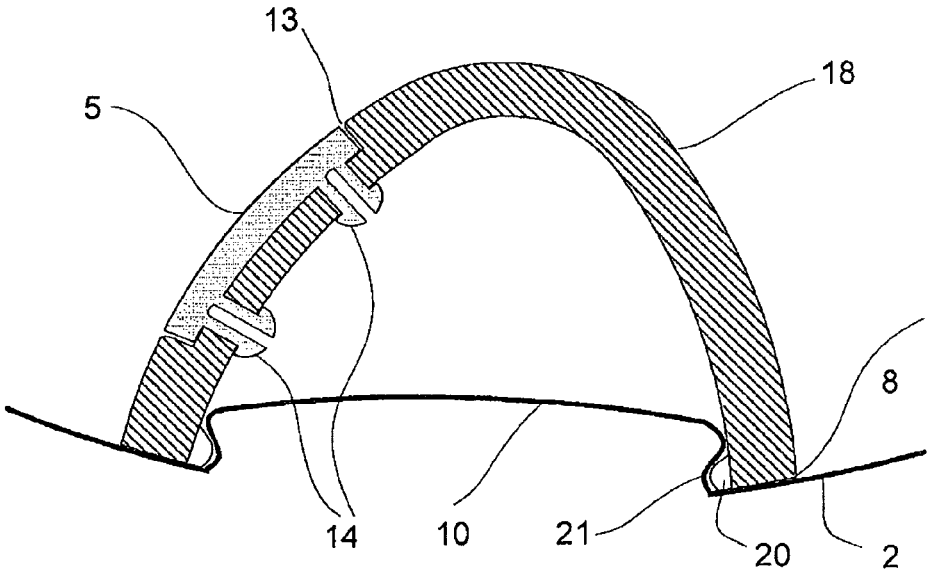
FIG. 7 shows an agitator with an insertion part and a formed in base body in a sectional view.

In FIG. 7, the base body 10 is formed into the drum casing 2. With the agitators 3 (FIG. 8) arranged inclined to the rotation axis of the drum 2 and the curved agitators 3 (FIGS. 11 and 12), the base bodies 10 have the same form for all the agitators 3 of different designs and, in all the examples, are oriented parallel to the axis of the drum casing 2, and are fastened with a screw connection 9. The locking lugs 20 of the molded body 18 and the counter-detents 21 in the base bodies 10 are similarly dimensioned and configured for different embodiments to correspond to one another.

The base body 10, the molded body 18 and the locking means 20, 21 are configured such that the molded body 18 can be mounted from the interior of the drum 2 with the base body 10 firmly attached to the drum inner wall 2. The molded body 18 is a plastics part with elasticity of shape which, on assembly, is placed on the base body 10 and locks therewith by application of radial pressure. Assembly is carried out by hand without tools. The assembly is simplified in the exemplary embodiments in FIGS. 8, 11 and 12 by a longitudinal slot 22 in the base body 10, which gives said base body additional elasticity of shape.

The insertion part 5 is also connected to the molded body 18 by locking. The locking rivets 14 of the insertion part 5 can engage through the molded body 18 (FIG. 7) or, similarly to FIG. 6, be introduced thereinto. The insertion part 5 can be added before or after mounting of the molded body 18. This is associated with the advantage that the assembly sequence can be arranged in various ways.

Figure 11:
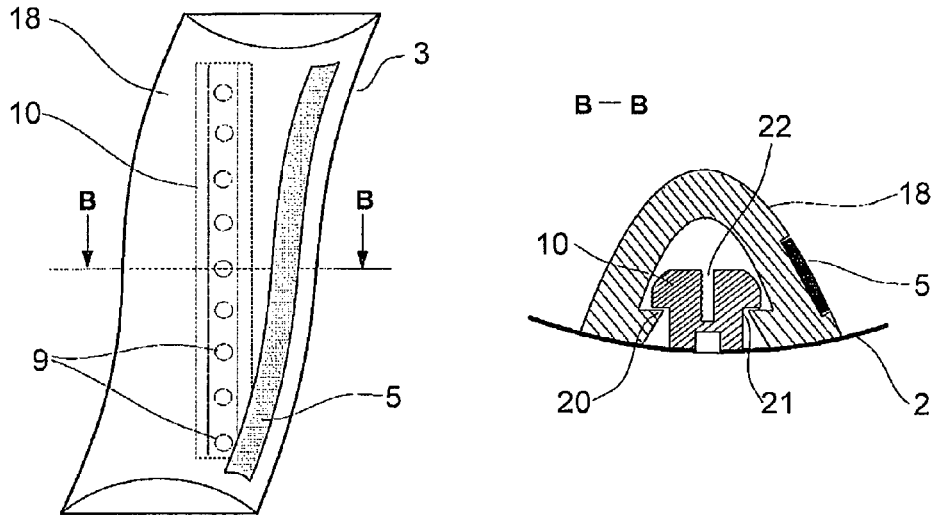
FIG. 11 shows an agitator with a molded body and an insertion part in a plan view and a sectional view.
Figure 12:
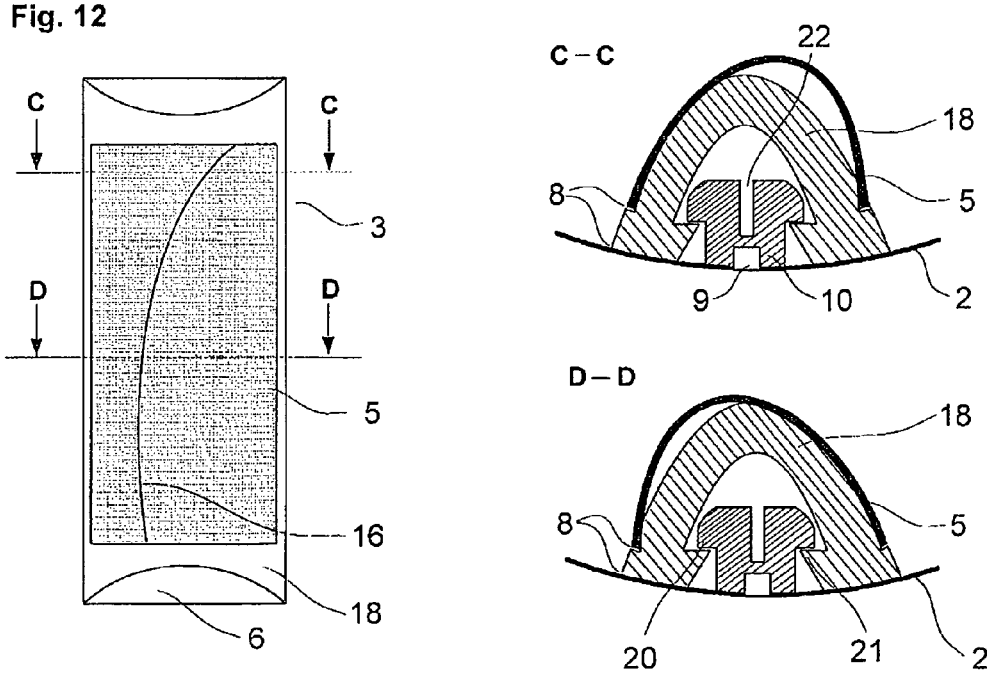
FIG. 12 shows an agitator with a molded body and an insertion part in a plan view and views of two sectional planes.

In the exemplary embodiments of FIGS. 8 and 11, the insertion part 5 is adapted to the geometry of the molded body 18. It is differentiated by color from the molded body 18 and serves in both examples to differentiate the visual perception. In another agitator 3 (FIG. 12), the insertion part 5 is also used to give the agitator 3 a special form and function. In this exemplary embodiment, the insertion part 5 has a curved crest line 16.

In the detail drawing (section A-A) in FIG. 9, an advantageous embodiment of the molded body 18 is shown. The outer edge region 8 of the contact surface is formed narrowing to a point towards the drum wall 2. On locking of the molded body 18, a lip-like narrowing 17 is elastically deformed in the edge region 8 and is spread outwardly. The locking connection is thereby subjected to an increased elastic tension. Any manufacturing tolerance variations are compensated for by the special embodiment of the molded body 18 and the formation of gaps in the contact region of the molded body 18 with the drum casing 2 is reliably avoided.

In the exemplary embodiment of FIG. 10, in order to secure the locking connection of the molded body 18 and the base body 10, an additional tensioning connection is provided. This tensioning connection is produced in a second operational step, wherein the molded body 18 is pressed by the application of pressure in the direction of the arrow, i.e. in the longitudinal direction of the axially oriented agitator 3. Due to the slightly wedge-shaped contact surfaces of the locking, the molded body 18 is pressed against the drum casing 2, so that it lies without a gap against the drum casing 2. The tensioning connection is very reliable, since the forces applied to the agitator 3 act mainly in the tangential direction during operation of the washing machine 1. Wedge-shaped scales 19 formed on the contact surfaces 11, 12 which interlock with one another on tensioning of the molded body 18 against the base body 10 prevent loosening of the tensioning connection.

The invention is not restricted to the special features disclosed in the exemplary embodiments described. With regard to the different types of functional parts, various other designs of the base body and the connecting elements are possible. These could include damping bodies which serve, for example, to balance out unevenly distributed masses in the drum, particularly in drums that can be loaded from the casing side. Measuring sensors can also be fastened in a drum in order, for example, to measure the temperature of the washing water or drying air and transmit them by radio to the control device. Components of a liquid flow system which, for example, are intended to ensure, in the case of drums mounted inclined, that the laundry items are evenly wetted and flushed through, or ensure the distribution of washing agents or additives, should also be considered for mounting in a drum. In the case of driers, components for an air inflow or outflow system may be required and these are to be attached in a similar manner as the previously described agitators.

In particular, as a result of the three-part structure, the agitators 3 can be produced in an almost unlimited variety of designs. As stated in the description of the exemplary embodiments, the invention is technically and technologically simple to carry out. The effort involved in implementing the invention is low and the conversion of production to drums 2 with differently designed agitators 3 and the subsequent exchange thereof or the subsequent conversion thereof is possible on a short time-scale.

The invention claimed is:

1. A modular system of laundry care devices including washing machines and/or driers, the modular system comprising:

a plurality of drums, the plurality of drums including a first drum and a second drum;

a plurality of different functional parts, each functional part having a different function, the plurality of different functional parts including:

a first functional part having a first function and a second functional part having a second function, wherein each functional part is selected from a group of functional part types consisting of agitators, damping bodies, measuring sensors, components of a fluid system, components of a washing agent and additive dosing system, and components of a treatment air system, wherein the first functional part is a different type of functional part than the second functional part, and each functional part includes:

a base body configured to be removably attached to a respective drum of a laundry care device, each base body being identically configured and interchangeable on the drums with the other base bodies; and a functional portion to provide the function of the respective functional part, wherein each functional portion has a specific laundry function that is different from a laundry function of the other functional portions, wherein the base body of the first functional part is removably attached to the first drum, and the base body of the second functional part is removably attached to the second drum, wherein each identically configured interchangeable base body while being attached to a respective drum of a laundry care device is configured for individual mounted receipt of each functional portion, with each functional portion being interchangeable on a respective one of the identically configured interchangeable base bodies while the respective identically configured interchangeable base body is attached to the respective drum, wherein the functional portion of the first functional part is detachably mounted on the base body of the first functional part, and the functional portion of the second functional part is detachably mounted on the base body of the second functional part, and wherein the specific laundry function of each functional portion causes a respective functional part, when attached to a respective drum of a laundry care device, to function differently than the other functional parts would function when attached to respective drums of laundry care devices, during operation of the laundry care device.

2. The modular system according to claim 1, wherein the functional portion of the first functional part includes:

a molded body which is configured to be installed on a first base body of the identically configured interchangeable base bodies; and at least one insertion part which is configured to be installed on the molded body, wherein the at least one insertion part is a component part of a set of insertion parts.

3. The modular system according to claim 2, wherein the molded body primarily determines at least one of a first geometry and the first function of the first functional part, and the at least one insertion part is primarily designed to enhance an appearance of the first functional part and/or to identify a model of a laundry care device.

4. The modular system according to claim 2, wherein an edge region of the molded body lying on a drum casing of the respective drum is formed with a lip-shaped narrowing region.

5. The modular system according to claim 2, wherein the at least one insertion part fits flush with the molded body at edges of the molded body.

6. The modular system of claim 1, wherein the first functional part is an agitator, and wherein an insertion part is insertable in the agitator.

7. The modular system of claim 2, wherein the molded body determines the first function of the first functional part.

8. The modular system according to claim 1, wherein each functional portion has a connection portion to connect to the identically configured interchangeable base bodies.

9. The modular system according to claim 1, wherein the identically configured interchangeable base bodies are configured to be removably attached to the respective drum via a fastener.

10. The modular system according to claim 9, wherein each functional portion includes a connection portion to connect to the identically configured interchangeable base bodies independently of the fastener.

11. The modular system according to claim 1, wherein the functional portion of the first functional part includes a molded body.

12. The modular system according to claim 11, wherein the functional portion of the first functional part includes an insertion part to be inserted into a respective molded body.

13. The modular system according to claim 11, wherein the molded body forms at least part of an agitator.

14. The modular system according to claim 1, wherein the functional portion of the first functional part includes a convex portion.

15. The modular system according to claim 1, wherein the functional portion of the first functional part includes a curved crest line on an agitator.

16. The modular system according to claim 1, wherein the first functional part is an agitator, and the second functional part is a damping body, a measuring sensor, a component of a fluid system, a component of a washing agent and additive dosing system, or a component of a treatment air system.

17. A modular system of laundry care devices including washing machines and/or driers, the modular system comprising:

a plurality of drums, the plurality of drums including a first drum and a second drum;

a plurality of different agitators, each agitator having a different function, the plurality of different agitators including:

a first agitator having a first function and a second agitator having a second function different than the first function, wherein each agitator includes:

a base body configured to be removably attached to a respective drum of a laundry care device, each base body being identically configured and interchangeable on the drums with the other base bodies; and a functional portion to provide the function of the respective agitator, wherein each functional portion has a geometrical form that is different from a geometrical form of the other functional portions, wherein the base body of the first agitator is removably attached to the first drum, and the base body of the second agitator is removably attached to the second drum, wherein each identically configured interchangeable base body while being attached to a respective drum of a laundry care device is configured for individual mounted receipt of each functional portion, with each functional portion being interchangeable on a respective one of the identically configured interchangeable base bodies while the respective identically configured interchangeable base body is attached to the respective drum, and wherein the functional portion of the first agitator is detachably mounted on the base body of the first agitator, and the functional portion of the second agitator is detachably mounted on the base body of the second agitator, wherein the geometrical form of each functional portion is configured to cause a respective agitator, when attached to a respective drum of a laundry care device, to function differently than the other agitators would function when attached to respective drums of laundry care devices, during operation of the laundry care device.

18. The modular system according to claim 17, wherein the functional portion of the first agitator includes:

a molded body which is configured to be installed on a first base body of the identically configured interchangeable base bodies; and at least one insertion part which is configured to be installed on the molded body, the at least one insertion part is a component part of a set of insertion parts.

19. The modular system according to claim 17, wherein each functional portion has a connection portion to connect to the identically configured interchangeable base bodies.

20. The modular system according to claim 17, wherein the identically configured interchangeable base bodies are configured to be removably attached to the respective drum via a fastener.

21. The modular system according to claim 17, wherein the geometrical form of the functional portion of the first agitator or the geometrical form of the functional portion of the second agitator includes a convex portion.

22. The modular system according to claim 17, wherein the geometrical form of the functional portion of the first agitator or the geometrical form of the functional portion of the second agitator includes a curved crest line.

* * * * *